US005806100A

United States Patent [19]

De Scandiffio

[11] Patent Number: 5,806,100

[45] Date of Patent: Sep. 15, 1998

[54] FAUX SKIRT

[76] Inventor: Irma De Scandiffio, 4390 Lorcom La. North, Apt. 203, Arlington, Va. 22207

[21] Appl. No.: 916,452

[22] Filed: Aug. 22, 1997

Related U.S. Application Data

[63] Continuation of Ser. No. 62,840, Nov. 27, 1996, Pat. No. Des. 388,938.

[51] Int. Cl.[6] ..... A41D 1/14

[52] U.S. Cl. ..... 2/211; 2/228; 2/69

[58] Field of Search ..... 2/69, 70–72, 74, 2/75, 211–213, 227–228, 238, 78.1, 73

[56] References Cited

U.S. PATENT DOCUMENTS

| | | | |
|---|---|---|---|
| D. 157,556 | 3/1950 | Ackerman . | |
| D. 230,538 | 3/1974 | Hansen . | |
| 549,472 | 11/1895 | Winthrop | 2/212 |
| 562,140 | 6/1896 | McCartney | 2/212 |
| 1,121,177 | 12/1914 | Forbes . | |
| 1,280,963 | 10/1918 | Copenhafer | 2/213 |
| 1,807,908 | 6/1931 | Freed | 2/213 |
| 2,091,441 | 8/1937 | Hauser | 2/212 |
| 2,325,924 | 8/1943 | Terry . | |
| 2,368,189 | 1/1945 | Wolman et al. | 2/213 |
| 2,420,769 | 5/1947 | Calvin . | |
| 2,613,363 | 10/1952 | Morgan | 2/212 |
| 3,164,843 | 1/1965 | Erteszek . | |
| 3,315,274 | 4/1967 | Roody . | |
| 3,399,679 | 9/1968 | Barg . | |
| 3,961,376 | 6/1976 | Howell . | |

FOREIGN PATENT DOCUMENTS

| | | | |
|---|---|---|---|
| 459700 | 1/1937 | United Kingdom | 2/212 |

*Primary Examiner*—Gloria M. Hale
*Attorney, Agent, or Firm*—Jacobson, Price, Holman & Stern, PLLC

[57] ABSTRACT

A garment that includes the attribute of a pair of shorts and which includes a front panel and a rear panel to span a gap formed between the legs of the shorts. The front panel and rear panel provide the appearance of continuous front and rear surfaces, normally associated with a skirt. Both the front panel and the rear panel extend from and are secured at one edge to the waist of the garment. The panels extend downwardly to the lowermost edge of the two leg portions of the shorts. Opposed side edges of the panels are secured approximately half-way along the height of the garment to the mid-section of the garment. The panels then become a free bottom portion, including hemmed edges which are detached from the garment so as to produce a free end swinging panel portion. This aids in providing the appearance of a skirt formed of a plurality of panel portions. Pockets are optionally included on the front of the garment and may optionally be included on the rear of the garment. Also, optional belt loops combined with an elasticized or partially elasticized waist may be included.

7 Claims, 5 Drawing Sheets

FAUX SKIRT

This application is a continuing application of Ser. No. 29/062,840, filed Nov. 27, 1996 now Des. Pat. No. 388,938.

FIELD OF THE INVENTION

The present invention relates to a garment designed to include the attributes of a pair of shorts while providing the appearance of a skirt.

BACKGROUND OF THE INVENTION

Traditionally, clothing has been designed with an emphasis on fashion over function. Accordingly, often times, in a work environment, for example, women are expected to dress with a greater concern for appearance to the possible detriment of personal comfort.

With the advent of "casual Fridays" in the work place, individuals have been given an opportunity to dress in more casual attire. This has resulted in a demand for casual attire which meets the dress code standards that have been invoked in certain work places.

The trend towards causal days in the work place has caused a shift in the design world to accommodate a potential 20% reduction in demand for formal attire during a typical work week. Efforts to date have not achieved the desired goal of meeting the standards of dress codes in the work place, even relaxed dress codes, which may exclude the wearing of shorts. Accordingly, there is a need to satisfy the individual with comfortable clothing which provides the required appearance for attire.

SUMMARY OF THE INVENTION

It is therefore an object of the present invention to provide a garment that includes the attributes of a pair of shorts and which includes a front panel and a rear panel to span a gap formed between the legs of the shorts. The front panel and rear panel provide the appearance of continuous front and rear surfaces, normally associated with a skirt. Accordingly, by the present invention, a garment having the favorable attributes of a pair of shorts provides the appearance of a skirt.

Both the front panel and the rear panel, in a preferred embodiment, extend from and are secured at one edge to the waist of the garment. The panels extend downwardly to the lowermost edge of the two leg portions of the garment. Opposed side edges of the panels are secured approximately half-way along the height of the garment to the mid-section of the garment. The panels then include a free bottom portion, including hemmed edges which are detached from the garment so as to produce a free end swinging panel portion. This aids in providing the appearance of a skirt formed of a plurality of panel portions. Pockets are optionally included on the front of the garment and may optionally be included on the rear of the garment. Also, optional belt loops combined with an elasticized or partially elasticized waist may be included.

By providing both a front and a rear panel, a gap between the two leg portions of the garment cannot be seen. Therefore, although the individual is in effect wearing shorts, to the remainder of the world, an appearance is provided of wearing a skirt.

Accordingly, it is another object of the present invention to provide a garment which includes a waist portion and two leg portions and includes a front panel and a rear panel which overly a gap formed between the two leg portions so as to provide the appearance of a skirt.

It is yet another object of the present invention to provide a garment having a waist portion and two leg portions with a gap formed between the two leg portions and a front panel and a rear panel extending from the waist portion to a lowermost edge of the leg portions which overlies the gap formed between the leg portions to provide the appearance of a skirt.

It still yet another object of the present invention to provide a garment having a waist portion and two leg portions with a gap formed between the two leg portions and having a front panel and a rear panel partially secured to the leg portions and having a free end overlying the gap formed between the two leg portions so as to provide the appearance of a skirt.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
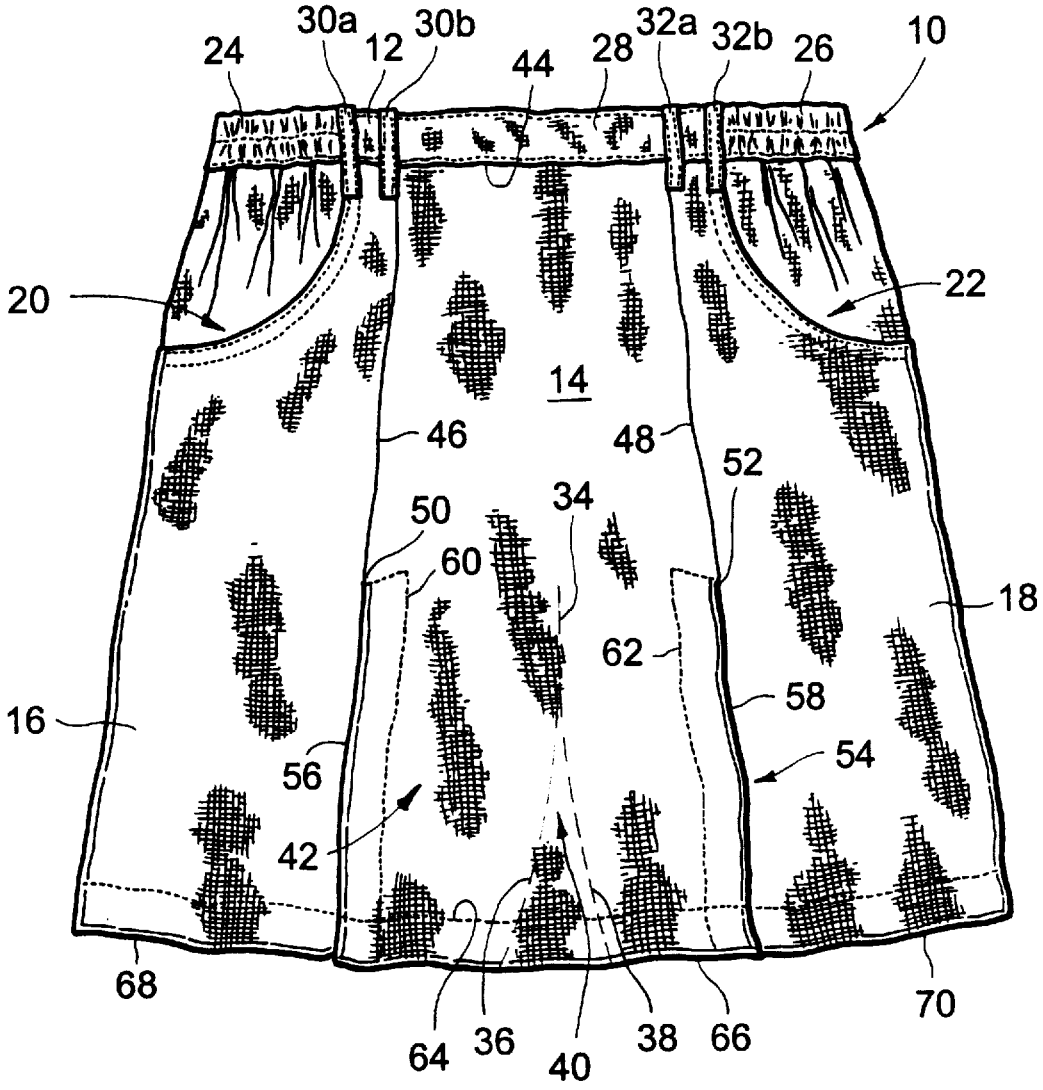
FIG. 1 is a front view of the faux skirt of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
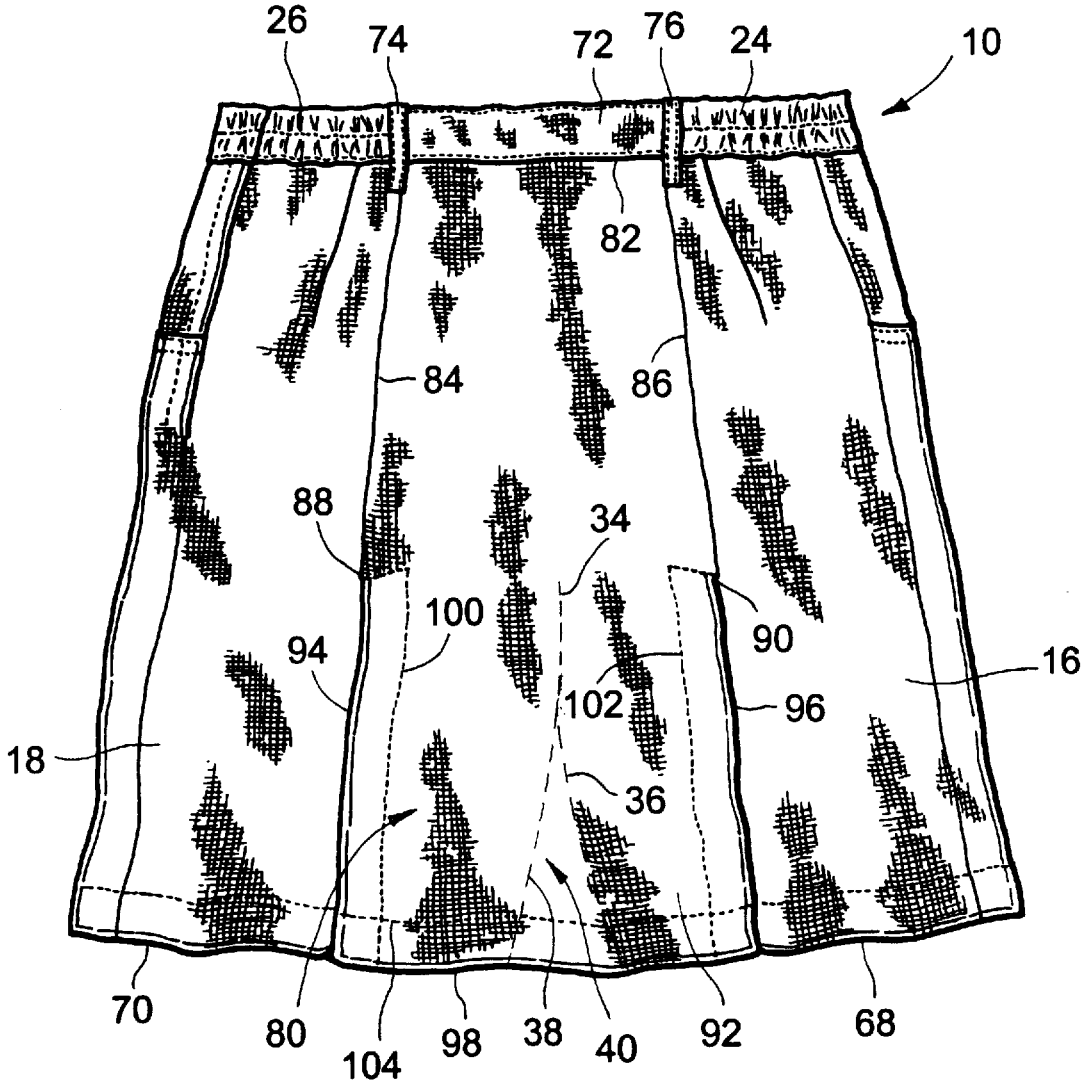
FIG. 2 is a rear view of the faux skirt according to the present invention.
Figure 3:
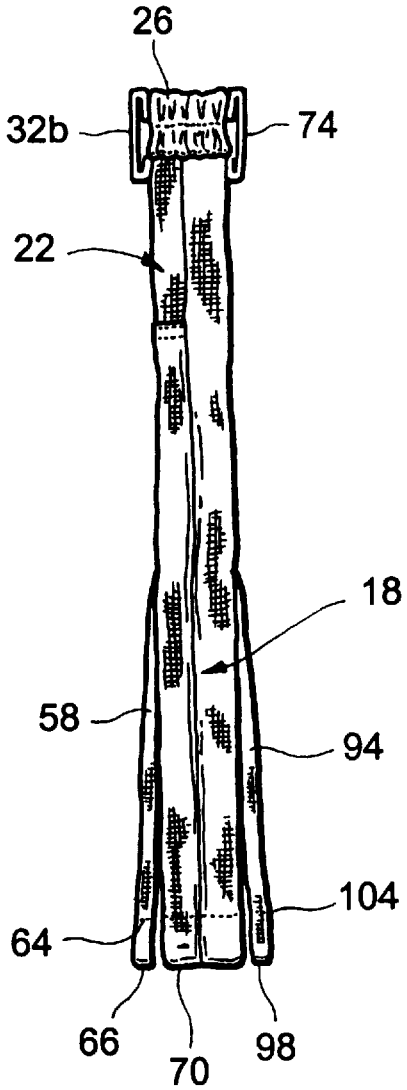
FIG. 3 is a side elevational view of the faux skirt according to the present invention.
Figure 4:
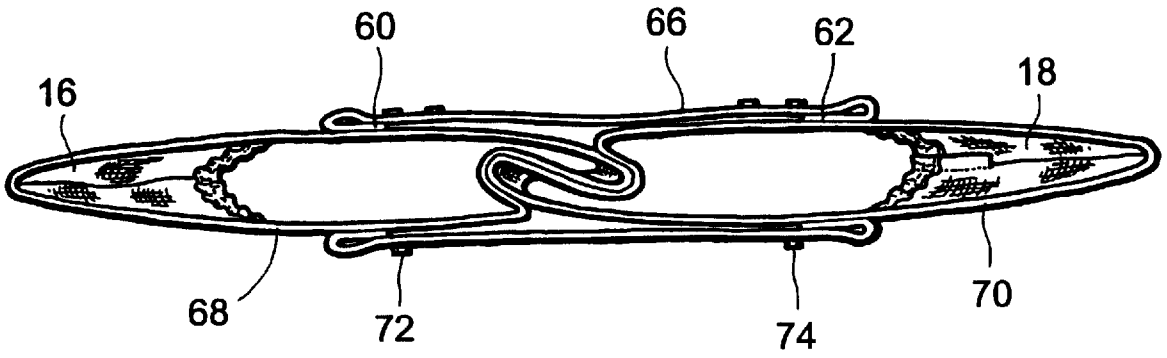
FIG. 4 is a bottom view illustrating the two leg portions and a front panel and a rear panel covering a bottom portion of the two leg portions so as to provide an appearance of a skirt.

With reference to the drawings, in general, and to FIGS. 1 through 3, in particular, a faux skirt embodying the teachings of the subject invention is generally designated as 10. With reference to its orientation in FIG. 1, the faux skirt 10 includes a waist portion 12, a mid-section 14 and two leg portions 16, 18. The various elements, taken in combination, have the attributes of forming a pair of shorts.

In the front surface shown in FIG. 1, two pockets 20, 22 are shown. In addition, the waist portion includes elasticized portions 24, 26 located on opposite sides of a non-elasticized portion 28. Located between the elasticized portions 24, 26 and non-elasticized portion 28 are two belt loops 30*a*, 30*b* on one side of elasticized portion 28 and two belt loops 32*a*, 32*b* located on the opposite side of non-elasticized portion 28.

At the bottom of mid section 14 the inner edges of leg portions 16, 18 are separated, as indicated by phantom line 34. Continuing downwardly along the separation line 34, the inner edge 36 (shown in phantom line) of leg portion 16 is separated from the inner edge 38 (shown in phantom line) of leg portion 18 to form a gap 40 therebetween.

A front panel 42 covers the gap 40. The front panel 42 extends from and is secured at its uppermost edge 44 in non-elasticized portion 28. The front panel extends downwardly from uppermost edge 44 along opposed side edges 46, 48. The edges 46, 48 are secured to the mid-section 14 of the garment. The uppermost edge 44 and side edges 46, 48 of the front panel 42 are the only connection to the overall garment. Accordingly, the front panel 42 is separable from the garment. The garment includes material spanning between the edges 46, 48, but beneath the front panel 42.

At a point 50, 52, of the side edges 46, 48, respectively, located approximately at the beginning of the separation line 34 between the leg portions 16, 18, the lower or remaining portion of the front flap 42 forms a free or unsecured portion 54. The free portion 54 hangs downwardly over the gap 40 between the leg portions 16, 18. The remaining side edge portions 56, 58 are folded under and secured by stitch lines 60, 62, respectively, to form a hemmed folded under the free portion 54. Similarly, stitch line 64 forms a hemmed edge 66 at the lowermost edge of the free portion 54. Hemmed edge 66 is aligned with the lowermost hemmed edges 68, 70 of the leg portions 16, 18, respectively.

On the rear surface of the garment, as shown in FIG. 2, the elasticized portions 24, 26 continue onto the rear of the garment and are separated by a non-elasticized portion 72. Located between the elasticized portion 26 and non-elasticized portion 72 is a belt loop 74. Similarly, between the elasticized portion 24 and the non-elasticized portion 72 is a belt loop 76.

On the rear surface, a rear panel 80 extends from an uppermost edge 82 located at the non-elasticized waist portion 72 along two opposed side edges 84, 86 until reaching a point, 88, 90, respectively. As with the front panel, the rear panel is only secured to the garment along edges 82, 84 and 86. The garment includes material spanning between the edges 84, 86, but beneath the rear panel 80.

At points 88, 90, a bottom free portion 92 of panel 80 hangs freely over the separation line 34, and the edges 36, 38 of the leg portions 16, 18, respectively. The panel 80 covers the gap 40 formed between the leg portions 16, 18. The edges 94, 96 of the free portion 92 extend to a lowermost seam 98 hemmed by stitch lines 100, 102, 104, respectively.

Figure 5:
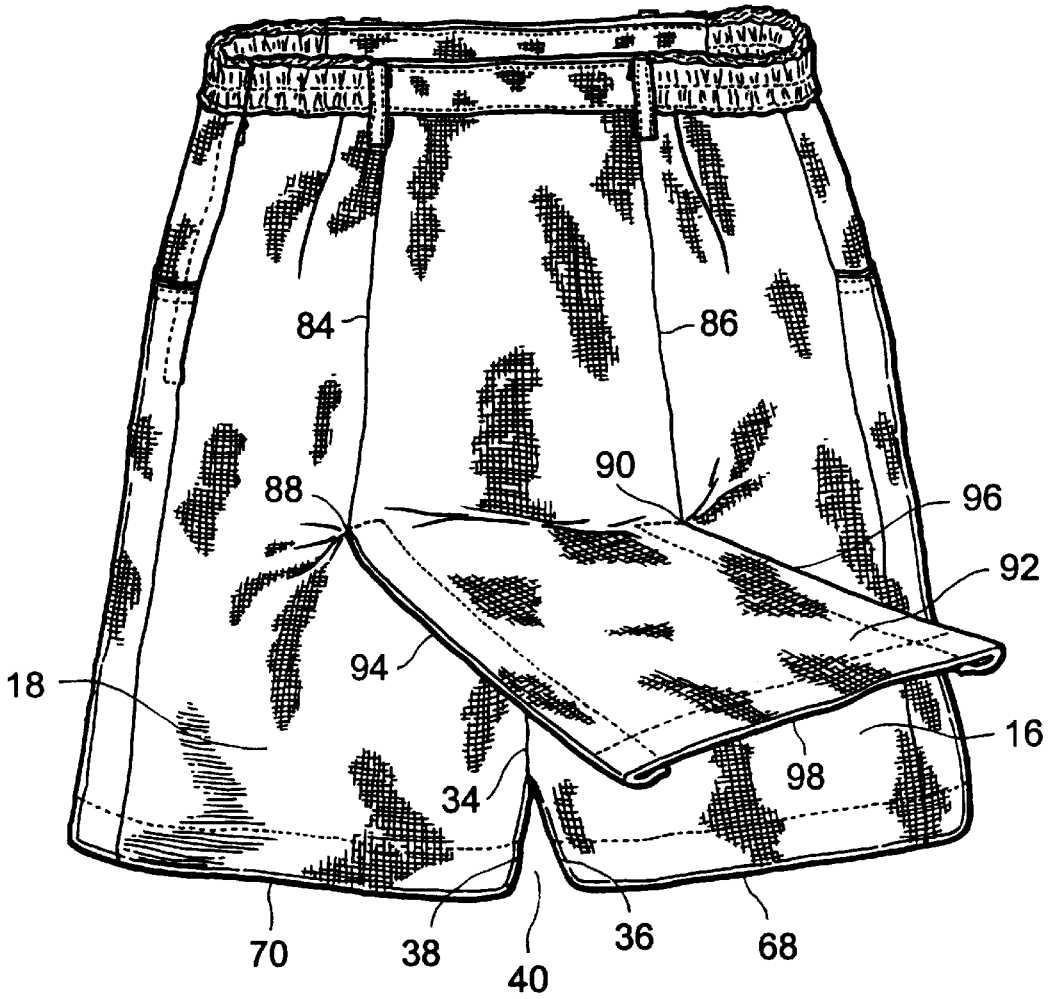
FIG. 5 is a rear view with a free end portion of the rear panel elevated to illustrate the covering of a gap formed between the two leg portions, it being understood that the front panel similarly has a free end portion which overlies the gap formed between the two leg portions so as to provide the appearance of a skirt in both the front and the rear of the garment.

As shown in FIG. 5, the free portion 92 is movable away from the leg portions 16, 18 at points 88, 90 where the side seam portions 94, 96 separate from the garment as compared to opposed side seam portions 84, 86. When the free portion 92 is moved to the position shown in FIG. 5, for illustrative purposes, the gap 40 formed between the leg portion 16, 18 is exposed to reveal the true nature of the garment, namely a garment having the attributes of a pair of shorts.

The free portion 54 of the front flap 42 operates in exactly the same way as the rear flap 80. Accordingly, both the front flap 42 and the rear flap 80 serve to cover the separation between leg portions 16, 18. The front panel and rear panel hanging downwardly to a lowermost edges 68, 70 of the leg portions provide the appearance of a paneled skirt, as shown in FIGS. 1 and 2, unbeknownst to the world that in reality, the individual is wearing a garment having the attributes of a pair of shorts. Accordingly, the comfort and convenience known to be associated with a pair of shorts can be appreciated by the wearer, while presenting to the world the appearance of a garment, more formal in nature, namely a skirt.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A garment comprising:

a waist portion, two leg portions, a mid-section extending between said waist portion and said two leg portions, a separate front panel hanging downwardly over a gap formed between said two leg portions, and a separate rear panel hanging downwardly over the gap formed between said two leg portions to provide, with said front panel, the appearance of a skirt while functioning as a pair of shorts, said front panel and said rear panel including a secured portion being each respectively permanently secured along opposed side edges and along said waist from said waist portion to said mid-section, said front panel and said rear panel each include a free end portion extending from said secured portion of said front panel and said rear panel respectively, below said mid-section.

2. A garment as claimed in claim 1, wherein said front panel and said rear panel extend from said waist portion to a bottom edge of said leg portions.

3. A garment as claimed in claim 1, wherein the gap is formed between said two leg portions beginning at said mid-section.

4. A faux skirt comprising:

an encircling waist portion, two leg portions, a mid-section extending between said waist portion and said two leg portions, a gap formed between said two leg portions initiating from said mid-section, a separate front panel permanently secured at three edges to said waist portion and said mid-section and overlying the gap between said two leg portions, and a separate rear panel permanently secured at three edges to said waist portion and said mid-section and overlying the gap between said two leg portions to provide with said front panel, the appearance of a skirt while functioning as a pair of shorts, said front panel and said rear panel each include a free end portion extending from said front panel and said rear panel, respectively, below said mid section.

5. A faux skirt as claimed in claim 4, wherein said front panel and said rear panel extend from said waist portion to a bottom edge of said leg portions.

6. A faux skirt as claimed in claim 5, wherein said front panel and said rear panel are each respectively secured along opposed side edges to said mid-section.

7. A faux skirt as claimed in claim 4, wherein a lowermost edge of said front panel and a lowermost edge of said rear panel extend to a lowermost edge of said two leg portions.

* * * * *